US008590076B2

(12) United States Patent
Davis

(10) Patent No.: US 8,590,076 B2
(45) Date of Patent: Nov. 26, 2013

(54) RAPID EMERGENCY EVACUATION FRAME

(76) Inventor: David Davis, Los Angeles, CA (US)

( * ) Notice: Subject to any disclaimer, the term of this patent is extended or adjusted under 35 U.S.C. 154(b) by 0 days.

(21) Appl. No.: 13/206,064

(22) Filed: Aug. 9, 2011

(65) Prior Publication Data

US 2013/0036552 A1 Feb. 14, 2013

(51) Int. Cl.
*A47B 1/00* (2006.01)

(52) U.S. Cl.
USPC ..... 5/625; 5/628

(58) Field of Classification Search
USPC ..... 5/625–629, 658, 662
See application file for complete search history.

(56) References Cited

U.S. PATENT DOCUMENTS

| | | | | |
|---|---|---|---|---|
| 5,179,746 | A * | 1/1993 | Rogers | 5/625 |
| 5,481,770 | A * | 1/1996 | Ahlsten | 5/625 |
| 5,502,854 | A * | 4/1996 | Daouk | 5/627 |
| 5,829,078 | A * | 11/1998 | Rivers | 5/629 |
| 7,281,285 | B2 * | 10/2007 | Zucker et al. | 5/626 |
| 7,766,365 | B2 * | 8/2010 | Darling, III | 280/640 |
| 7,926,132 | B2 * | 4/2011 | Jordan | 5/626 |
| 2006/0016006 | A1 * | 1/2006 | Whitmore et al. | 5/601 |
| 2010/0077550 | A1 * | 4/2010 | Bertozzi | 5/625 |
| 2012/0102651 | A1 * | 5/2012 | Awerbuch et al. | 5/627 |

FOREIGN PATENT DOCUMENTS

| | | | | |
|---|---|---|---|---|
| GB | 2041764 A * | 9/1980 | | A61G 1/00 |

* cited by examiner

*Primary Examiner* — William Kelleher
*Assistant Examiner* — Richard G Davis
(74) *Attorney, Agent, or Firm* — Michael N. Cohen; Cohen I.P. Law Group P.C.

(57) ABSTRACT

An air liftable emergency evacuation frame is for transporting an injured person to an immediate medical aid. The evacuation frame comprises an elongated support structure that includes a support member assembly having a longitudinally extending pair of opposing poles. The support member assembly is configured to interconnect the pair of opposing poles to define a recessed area to place the injured person. A plurality of supporting means attached at a lower portion of the pair of opposing poles is adaptable to hold the elongated support structure when the emergency evacuation frame is placed on a surface with the injured person. At least one hole is employed at an upper portion of at least one of the pair of opposing poles to hold a detachable intravenous stand. The detachable intravenous stand allows a rescuer to hang an intravenous bag for providing a better flow of fluids.

4 Claims, 3 Drawing Sheets

RAPID EMERGENCY EVACUATION FRAME

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to evacuation frames, and more particularly to an air liftable is emergency evacuation frame for transporting an injured individual to an immediate medical aid.

DISCUSSION OF RELATED ART

A stretcher is a medical device used to carry an injured/immobile person from one place to another. The stretcher may be wheeled or carried by hand. Stretchers should be light weight, compact, efficient, strong, may be air liftable and should be easily accessible. Stretchers are intended for medical use in the military and for civilian use. Stretchers may contain straps for securely holding the body of the injured person. Stretchers must be washable and sanitary. Foldable stretchers are also available. Stretchers provide safety and the comfortable movement of patients and should reduce the risk of back injuries to emergency medical service personnel who lift them.

One prior art described in U.S. Patent Application No. 20090288255 issued to Sakurai on Nov. 26, 2009 discloses a stretcher that can be placed anywhere on any surface that can be moved by sliding easily and smoothly on rough surfaces including indoor carpets, stairs and various types of roads. The stretcher is equipped with a mattress on which an injured/immobilized person can be placed and a means for carrying it. A synthetic resin support panel is placed below the mattress with a designated thickness and flexibility, with dimensions similar to the mattress. However, when the stretcher is in the transporting state, there is a chance for the mattress to bend and which would cause is discomfort and further injury to the patient.

Another prior art described in U.S. Pat. No. 7,607,184 issued to Goodner on Oct. 27, 2009 describes a collapsible, fully functional, personal field stretcher. The field stretcher is incorporated into, and deployed from, the equipment or clothing worn by critical incident personnel. It is designed to be used to carry personnel when such personnel become injured or incapacitated in the line of duty. However, the stretcher described herein does not provide any means to attach an intravenous stand.

Another prior art described in U.S. Pat. No. 6,871,368 issued to Calkin on Nov. 29, 2005 describes a flexible drag stretcher arranged for storage and transport in a tightly rolled, compact cylindrical storage condition for hand-carrying and for mounting on the backpacks of soldiers and hikers. This stretcher can be unrolled into an operative condition arranged to safely secure an injured person thereon for emergency removal from the scene of au injury by one or more persons. This stretcher has a single center base panel formed of a flexible sheet material and a mounted pair of opposite, flexible side-torso flap members arranged to be snugly cinched against the sides of the torso portion of an injured person's body. Nonetheless, the stretcher does not address the need for a support at the correct position for the rescuer to perform Cardiopulmonary Resuscitation (CPR) on the injured person.

Therefore, there is a need for a stretcher that would be comfortable to the injured person while in the transport. Such a needed device would provide a support at the correct is position for the rescuer to perform CPR on the injured person. Further, such a needed device would provide an intravenous stand for hanging intravenous bags to provide a better flow of fluids, and free up the hands of two people to carry the stretcher. The present invention accomplishes all these objectives.

SUMMARY OF THE INVENTION

The present invention is an air liftable emergency evacuation frame for securely transporting an injured person to the immediate medical aid. The air liftable emergency evacuation frame comprises an elongated support structure that includes a support member assembly having a longitudinally extending pair of opposing poles. The support member assembly is configured to define a recessed area to place the injured person. A plurality of supporting means attached at a lower portion of the pair of opposing poles, wherein each supporting means comprises a plurality of vertical support members. At least one hole is employed at an upper portion of at least one of the pair of opposing poles to hold a detachable intravenous stand. The detachable intravenous stand allows a rescuer to hang an intravenous bag for providing a better flow of fluids and to free up the hands of the rescuer to carry the injured person securely. The air liftable emergency evacuation frame is light weight and is made of at least one of a polymer material. The elongated support structure is strong, compact and is easy to transport. The air liftable emergency evacuation frame can carry up to 600 lbs. The air liftable emergency evacuation frame is facilitates the rescuer to perform Cardio Pulmonary Resuscitation (CPR) to the injured person if necessary.

The air liftable emergency evacuation frame includes a shoulder strap and a leg strap, wherein saod leg strap comprises a first leg strap that forms a left leg loop, and a second leg strap that forms a right leg loop, to securely hold the body of an injured person to the elongated support structure. The frame requires a less storage area when the frame is not in use and the air liftable emergency evacuation frame can be easily transported from one place to another. A plurality of handles is attached at a plurality of terminal ends of the pair of opposing poles to carry the injured person. The elongated support structure measurements are 16" wide and 22" long. The frame could be easily carried by a user, so that the evacuation frame is easily accessible. The air liftable emergency evacuation frame is ergonomically made and can be used in all types of weathers. And the evacuation frame can be carried by four men or two men.

Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
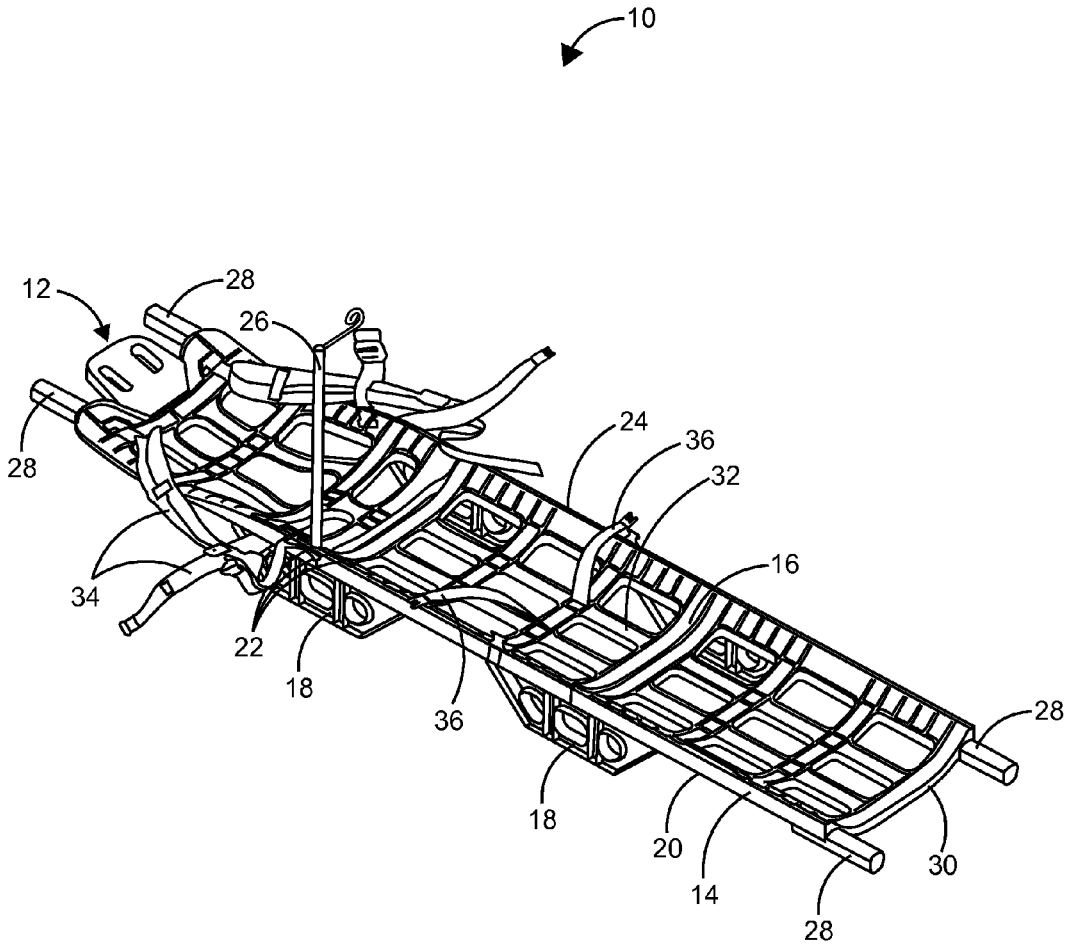
FIG. 1 shows a side perspective view of the invention, illustrating an air liftable is emergency evacuation frame.

FIG. 1 shows a side perspective view of an air liftable emergency evacuation frame 10 for securely transporting an injured person to an immediate medical aid. The air liftable emergency evacuation frame 10 comprises an elongated support structure 12 that includes a support member assembly 16 having a longitudinally extending pair of opposing poles 14. The support member assembly 16 being configured to define a recessed area 32 to place the injured person. A plurality of supporting means 18 attached at a lower portion 20 of the pair of opposing poles 14 and at least one hole 22 is employed at an upper portion 24 of at least one of the pair of opposing poles 14 to hold a detachable intravenous stand 26. Each of said plurality of supporting means 18 comprises a plurality of vertical support members. A plurality of handles 28 are attached at a plurality of terminal ends 30 of the pair of opposing poles 14 to carry the injured person. The evacuation frame 10 includes a shoulder strap 34 and a leg strap 36 to securely hold the body of the injured person to the elongated support structure 12. The leg strap 36 comprises a first leg strap that forms a left leg loop, and a second leg strap is that forms a right leg loop. The detachable intravenous stand 26 allows a rescuer to hang an intravenous bag (not shown) for providing a better flow of fluids and to free up the hands of the rescuer to carry the injured person securely. The elongated support structure 12 is strong, compact and is easy to transport.

Figure 2:
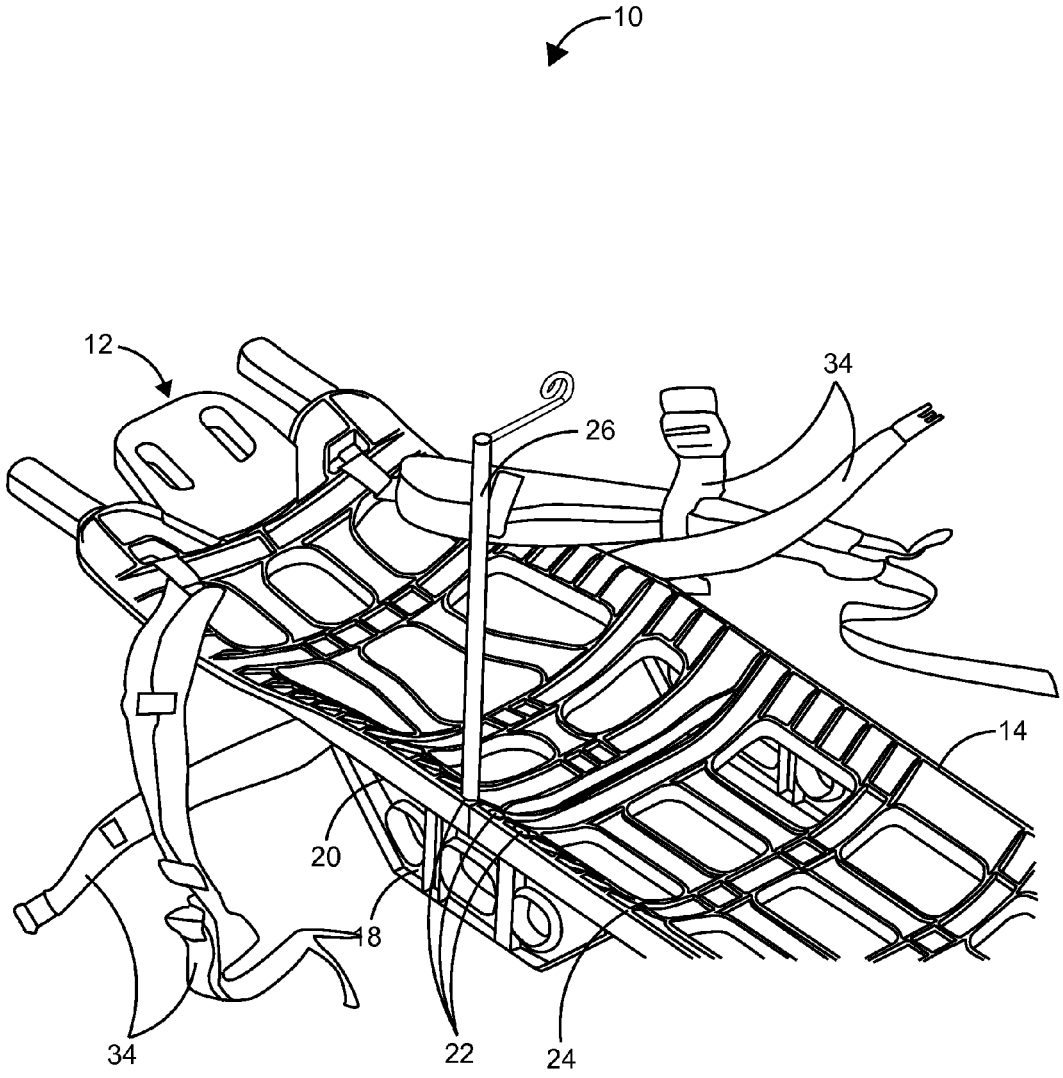
FIG. 2 is an enlarged side perspective view of a portion of the air liftable emergency evacuation frame of the FIG. 1, illustrating an intravenous stand.

FIG. 2 is an enlarged side perspective view of a portion of the emergency evacuation frame 10 of FIG. 1, illustrating the detachable intravenous stand 26. The detachable intravenous stand 26 allows a rescuer to hang an intravenous bag (not shown) for providing a better flow of fluids and to free up the hands of the rescuer to carry the injured person securely. The detachable intravenous stand 26 is removable and is slid into a plurality of slots (not shown) at a lower portion 20 of the pair of opposing poles 14 when not in use, wherein the detachable intravenous stand is simultaneously engaged with said plurality of slots when not in use. The detachable intravenous stand 26 is of 18" in length and 1/16" in width. The plurality of slots (not shown) is of half inch length and 1/8" width. At least one hole 22 is employed at an upper portion 24 of at least one of the pair of opposing poles 14 to hold the detachable intravenous stand 26. The size of each hole 22 is 1/8". The plurality of supporting means 18 is adaptable to hold the elongated support structure 12 when the air liftable emergency evacuation frame 10 is placed on a surface with the injured person. The shoulder strap 34 employed on the evacuation frame 10 secures the body of the injured person to the elongated support structure 12.

Figure 3:
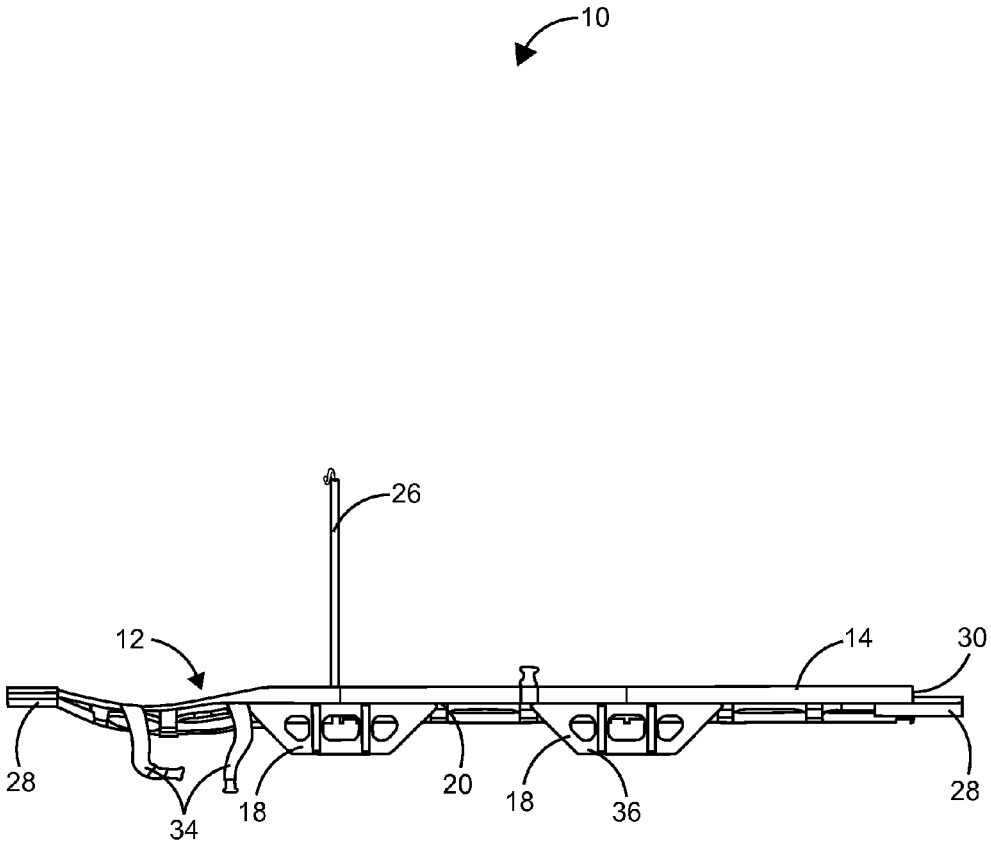
FIG. 3 shows the side view of the air liftable emergency evacuation frame.

FIG. 3 shows a side view of the air liftable emergency evacuation frame 10. The elongated support structure 12 can carry up to 600 lbs. The frame 10 facilitates the is rescuer to perform Cardio Pulmonary Resuscitation (CPR) to the injured person if necessary. The air liftable emergency evacuation frame 10 is made of at least one of a light weight polymer material. The pair of opposing poles 14 includes a plurality of supporting means 18 at the lower portion 20 thereof to hold the elongated support structure 12 when the air liftable emergency evacuation frame 10 is placed on the surface with the injured person. The detachable intravenous stand 26 allows a rescuer to hang an intravenous bag (not shown) for providing a better flow of fluids and to free up the hands of the rescuer to carry the injured person securely. The plurality of handles 28 attached at the plurality of terminal ends 30 of the pair of opposing poles 14 to carry the injured person.

While a particular form of the emergency evacuation frame has been illustrated and described, it will be apparent that various modifications can be made without departing from the spirit and scope of the invention. For example, the emergency evacuation frame 10 may be made of any suitable materials which would give more comfort to the injured person. Similarly, the frame may be employed to assemble and disassemble into different units by means of various attachment means or connecting means, making the frame 10 more compact and portable. Accordingly, it is not intended that the invention be limited, except as by the appended claims.

What is claimed is:

1. An air liftable emergency evacuation frame for transporting an injured person comprising:

an elongated support structure that includes a support member assembly having a longitudinally extending pair of opposing poles, the support member assembly being configured to interconnect the pair of opposing poles to define a recessed area to place the injured person;

a plurality of supporting means attached at a lower portion of the pair of opposing poles; wherein each of said plurality of supporting means comprises a plurality of vertical support members;

a plurality of straps to hold the injured person in correct position for air lift;

at least one hole employed at an upper portion of at least one of the pair of opposing poles to hold a detachable intravenous stand; and a plurality of handles attached at a plurality of terminal ends of the pair of opposing poles to carry the injured person;

whereby the detachable intravenous stand allows a rescuer to hang an intravenous bag for providing a better flow of fluids and to free up the hands of the rescuer to carry the injured person securely.

2. The air liftable emergency evacuation frame of claim 1 wherein the plurality of straps includes a shoulder strap and a leg strap to securely hold the injured person to the evacuation frame, wherein said leg strap comprises a first leg strap that forms a left leg loop, and a second leg strap that forms a right leg loop.

3. The air liftable emergency evacuation frame of claim 1 wherein the plurality of supporting means is adaptable to hold the elongated support structure when the emergency evacuation frame is placed on a surface with the injured person.

4. The air liftable emergency evacuation frame of claim 1 is made of at least one of a light weight polymer material.

* * * * *